United States Patent [19]

Willis

[11] Patent Number: 4,475,434

[45] Date of Patent: Oct. 9, 1984

[54] QUICK RELEASE DRUM HEAD ASSEMBLY

[76] Inventor: Ward L. Willis, P.O. Box 95, Breinigsville, Pa. 18031

[21] Appl. No.: 419,983

[22] Filed: Sep. 20, 1982

[51] Int. Cl.[3] ..... G10D 13/02

[52] U.S. Cl. ..... 84/411 R; 84/413

[58] Field of Search ..... 84/411–420

[56] References Cited

U.S. PATENT DOCUMENTS

| | | | |
|---|---|---|---|
| 795,034 | 7/1905 | Harris | 84/413 |
| 2,115,741 | 5/1938 | Newberry | 84/415 X |
| 3,533,324 | 10/1970 | Price | 84/411 R |
| 3,818,791 | 6/1974 | Zickos | 84/411 R |
| 4,188,852 | 2/1980 | Light | 84/411 A |

*Primary Examiner*—Lawrence R. Franklin

*Attorney, Agent, or Firm*—James C. Simmons

[57] ABSTRACT

A quick release drum head assembly having a flange over which the drum head is placed the flange including means to tension the drum head and secure the drum head assembly to a drum shell. Also disclosed is a constant height rim section assembly to fix the distance from the rim to the drum head regardless of the degree of tensioning of the drum head.

3 Claims, 5 Drawing Figures

FIG. 1
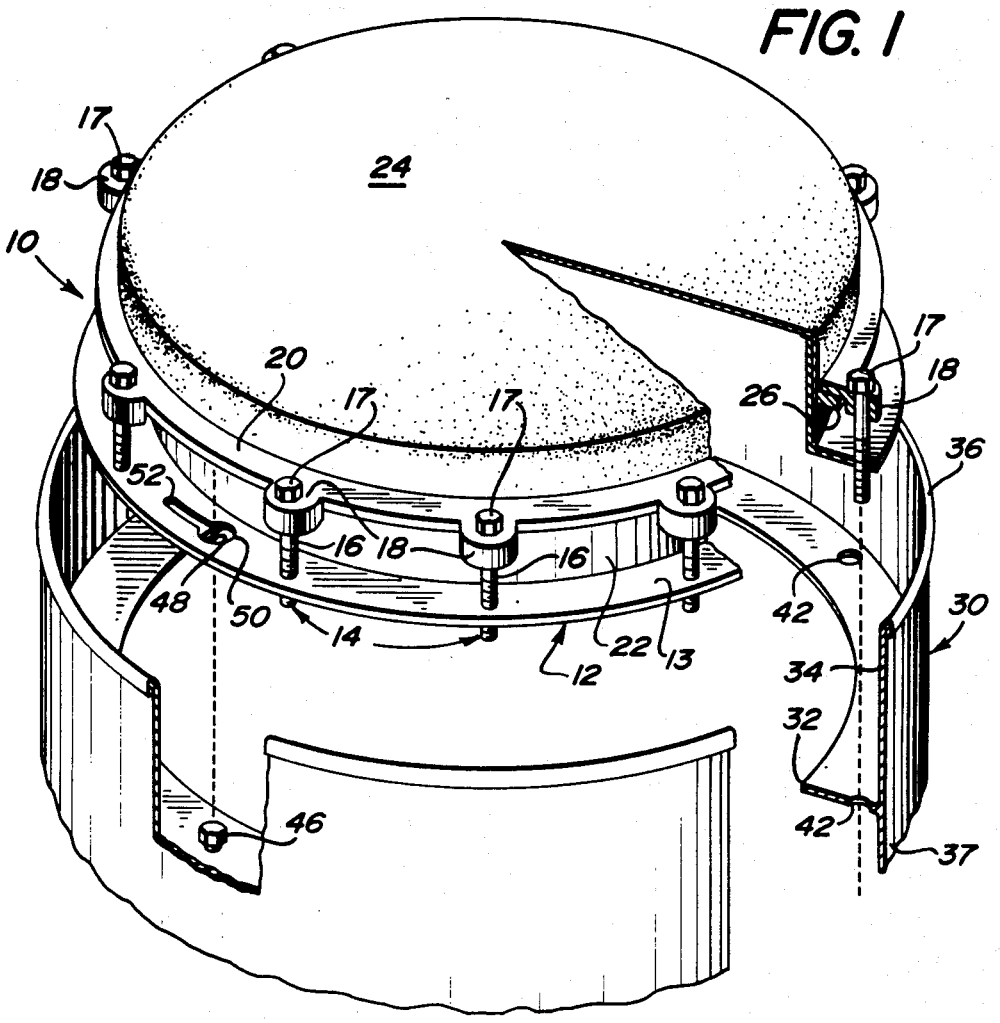
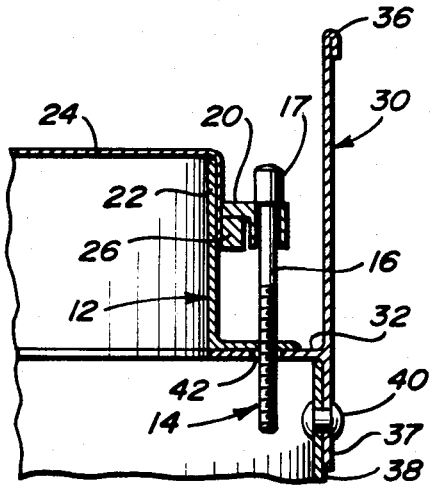
FIG. 5

FIG. 2
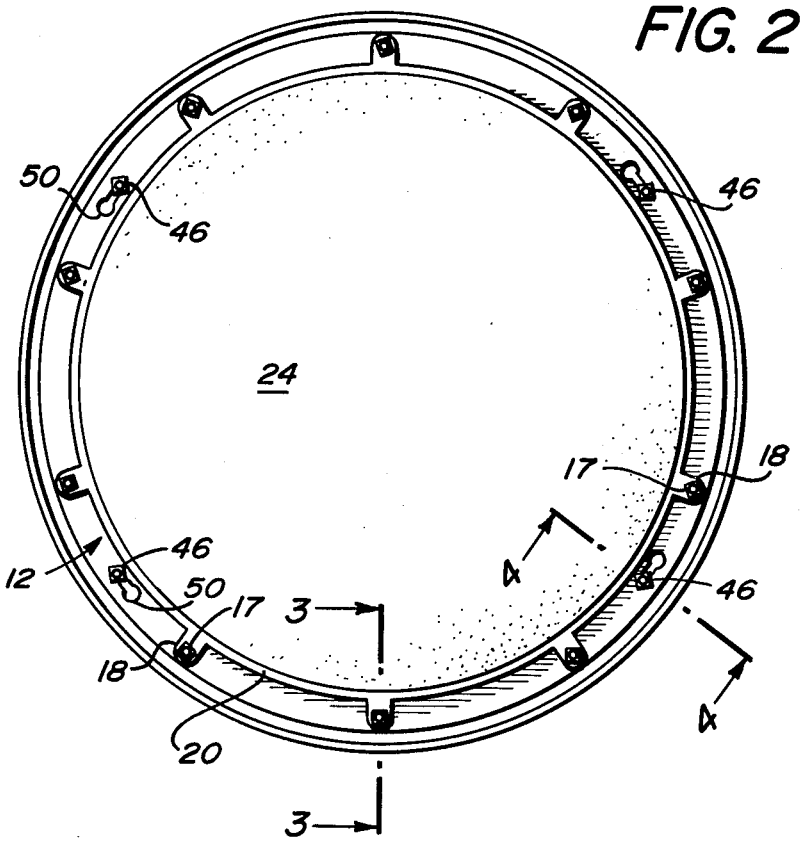
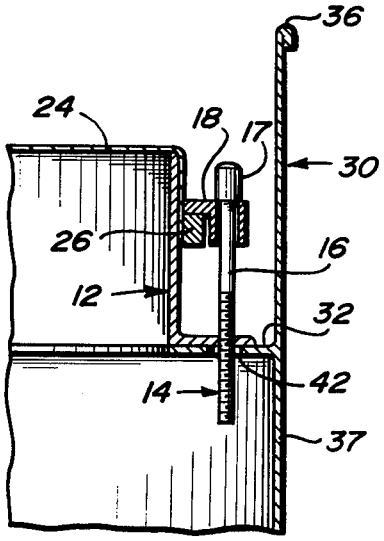
FIG. 3
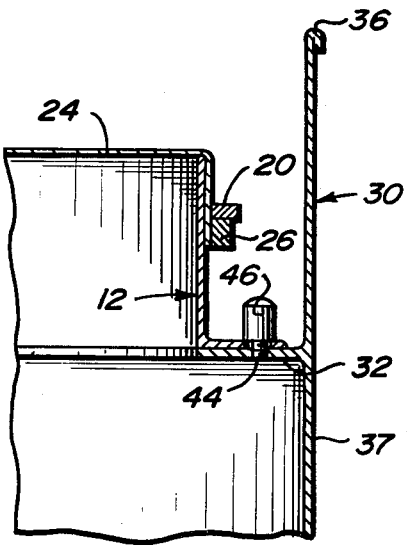
FIG. 4

QUICK RELEASE DRUM HEAD ASSEMBLY

TECHNICAL FIELD

The present invention pertains to percussion instruments and in particular to a quick release head assembly for a drum.

BACKGROUND OF THE PRIOR ART

Drums such as used to perform musical compositions have removable heads that can be tensioned to provide the proper notes. Conventional drum heads are fixed to a drum shell or body by a rim which is forced over the drum head which has been placed in the shell. The rim bears against an edge adaptor in the head thus as the rim is forced over the drum shell the drum head is tensioned. Conventional drums have a plurality of bolts or posts threadably engaged in receivers on the drum shell to fix and tension the drum head by holding the rim in a fixed position.

BRIEF SUMMARY OF THE INVENTION

A drum head assembly can be made to be readily adapted to a conventional drum shell by providing a flange-shaped drum head supporting member the base of the flange containing posts which tension the drum head and apertures which permit rapid attachment of the drum head assembly to a rim section of the drum. The drum head assembly permits pretensioning of the drum head so that in the event a head is ruptured, a new assembly can be fixed to the drum shell in a matter of seconds. A rim section can be fabricated in the drum shell with means to support the drum head at a constant distance or height from the rim. Alternatively, a fixed height rim section can be fabricated so that the rim section can be fitted to an existing drum shell.

BRIEF DESCRIPTION OF THE DRAWING

FIG. 1 is partially exploded, partially fragmentary perspective view of the drum head assembly and rim section of the present invention.

FIG. 2 is a top plan view of the apparatus of FIG. 1.

FIG. 3 is a section taken along the line 3—3 of FIG. 2.

FIG. 4 is a section taken along the line 4—4 of FIG. 2.

FIG. 5 is a section similar to FIG. 3 showing a separate rim section fixed to a conventional drum shell.

DETAILED DESCRIPTION OF THE PREFERRED EMBODIMENT

Referring to FIG. 1, the drum head assembly 10 consists of a generally flange-shaped drum head support 12. Support 12 includes a plurality of threaded apertures in base 13 to receive complimentary threaded bolts of posts 14. Posts 14 have an upper unthreaded portion 16 which fits through apertures in ears 18 of generally annular shaped drum head tension ring 20. The inner diameter of head tension ring 20 is sized to slidably fit over the vertical cylindrical portion 22 of support 12 to uniformly stretch drum head 24 over portion 22. Tension on drum head 24 is adjusted by forcing ring 20 down toward base 13 by means of tightening posts 14 so that ring 20 bears against edge stop 26 on drum head 24. Posts 14 include a suitable head 17 adapted to mate with a conventional wrench. Assembly 10 is sized to fit within a rim section 30. Rim section 30 includes a generally flat shelf portion 32 disposed generally perpendicular to the wall 34 of rim section 30. Wall 34 of rim section 30 has a first or rim end 36 which defines the upper playing end of the drum and a second end 37 which may be the entire drum shell (not shown) or an adaptor sleeve for retrofitting rim section 30 to an existing drum shell 38 by suitable fasteners 40 as shown in FIG. 5.

Shelf portion 32 includes a plurality of apertures 42 sized to permit posts 14 to move vertically to adjust drum head 24 (FIGS. 1, 3, and 5) and laterally or circumferentially along an arcuate section of shelf 32 as will hereinafter be more fully explained. Shelf portion 32 includes a plurality of threaded apertures 44 (FIG. 4) which have disposed therein cap screws or bolts 46.

Base 13 of flange 22 includes a plurality of tapered or key-shaped slots 48 sized so that slots 48 can at the large end 50 of the slot pass over the head of the cap screws 46 and at the small end 52 of the slot pass under the head of cap screw 46 spaced from the surface of shelf 32 to securely lock the base 13 of flange 22 to shelf 32 by a twist or rotation of drum head assembly 10 about a vertical axis which is both perpendicular to head 24 and the longitudinal axis of flange 22.

With a drum head assembly 10 according to the present invention, a spare drum head can be set up in a spare flange. If a head breaks, the drummer can change the head in a few seconds by twisting off the old assembly and twisting on the new. Conventional drums required the head to be removed by removing a plurality of tensioning rods from the rim, removing the rim, and head, installing a new head and reversing the process for installing the rim and tensioning rods, the process taking several minutes at best.

The rim section 30, whether built into the shell of the drum or as a means to retrofit an existing drum with a drum head assembly according to the present invention fixes the distance of the rim end 36 of rim section 30 from the drum head 24 regardless of the tension on drum head 24. As is known in the art in a conventional drum as more tension is applied to the drum head the upper edge or rim end of the tensioning rim is urged downward toward the head, thus changing the space between rim and head and in some cases forcing the rim below the head of the drum making it impossible for the drummer to execute the so-called rim-shot technique.

Having thus described my invention, what is desired to be secured by Letters Patent of the United States is set forth in the appended claims.

I claim:

1. A drum, comprising:

a shell having a rim section at one end thereof;

a generally flat, annular shelf extending inwardly from said rim section, said shelf having a plurality of cap screws threadly engaged around the top surface thereof, said shelf further having a plurality of holes therethrough; and a drum head assembly, comprising:

a drum head;

a drum head supporting member having a flange extending from the base thereof, said flange having a plurality of threaded holes and a plurality of tapered apertures spaced circumferentially therearound, one end of said tapered apertures adapted to receive said cap screws therethrough whereas the other end of said tapered apertures is smaller than the cap of said cap screws, whereby said supporting member may be removably fixed to said shelf by inserting said cap screws through said one end of said tapered apertures and by rotating said supporting member until said other end of said tapered apertures are located under said cap of said cap screws;

a drum head tensioning ring having holes spaced therearound; and tensioning bolts extending through said ring holes, being threaded into said flange threaded holes, and freely extending through said shelf holes.

2. A drum as in claim 1 wherein said rim section and said shelf are a unitary structure independent of said shell, and means for connecting said rim section to said shell.

3. A drum as in claim 1 wherein said tapered apertures are keyhole shaped.

* * * * *